US005613322A

United States Patent [19]

Kobrehel

[11] Patent Number: 5,613,322

[45] Date of Patent: Mar. 25, 1997

[54] EDGE DRIVE CABLE WINDOW REGULATOR ASSEMBLY

[75] Inventor: Michael D. Kobrehel, Elkhart, Ind.

[73] Assignee: Excel Industries, Inc., Elkhart, Ind.

[21] Appl. No.: 550,657

[22] Filed: Oct. 31, 1995

[51] Int. Cl.[6] ..... E05F 11/48

[52] U.S. Cl. ..... 49/352; 49/349

[58] Field of Search ..... 49/349, 352, 360, 49/380

[56] References Cited

U.S. PATENT DOCUMENTS

| | | | |
|---|---|---|---|
| 2,501,092 | 3/1950 | Rappl | 49/352 X |
| 4,110,935 | 9/1978 | Sessa . | |
| 4,910,917 | 3/1990 | Brauer . | |
| 4,934,099 | 6/1990 | Maekawa et al. | 49/352 |
| 5,035,083 | 7/1991 | Kruzich | 49/352 |
| 5,074,077 | 12/1991 | Toyoshima et al. | 49/352 |
| 5,120,151 | 6/1992 | Farris et al. . | |
| 5,195,211 | 3/1993 | Krajenke . | |
| 5,226,259 | 7/1993 | Yamagata et al. | 49/352 X |
| 5,263,282 | 11/1993 | Cooper et al. . | |

*Primary Examiner*—Philip C. Kannan

*Attorney, Agent, or Firm*—Banner & Witcoff, Ltd.

[57] ABSTRACT

A cable regulator assembly for controlling the vertical travel of a windowpane in the window opening of a motor vehicle has a cable support structure comprising first and second guide rail members extending vertically from laterally-spaced attachment to a lateral bridging member. The lateral bridging member, first guide rail member and second guide rail member cooperatively form an integral, rigid U-shaped structure. A regulator cable is mounted by suitable cable guide means for driven travel in a U-shaped travel path along the cable support structure. First and second gliders are attached to the regulator cable for cable-driven vertical travel along guide rails formed by the guide rail members. The gliders provide mounting means for attachment to the windowpane. The U-shaped cable support structure and corresponding U-shaped travel path of the regulator cable leave the center area of a door cavity advantageously clear of regulator assembly components. In addition, the rigid, integrated cable support structure provides excellent parallelism between the guide rails for improved regulator assembly performance characteristics, and optional rigid attachment of the windowpane to both gliders. The regulator cable is advantageously protected by the rigid lateral member bridging between the two guide rails.

12 Claims, 4 Drawing Sheets

EDGE DRIVE CABLE WINDOW REGULATOR ASSEMBLY

FIELD OF THE INVENTION

The present invention is directed to a cable regulator assembly suitable for controlling the position of a windowpane in a motor vehicle door window opening. More particularly, the invention is directed to a cable regulator assembly having an improved cable routing support structure.

BACKGROUND

Cable regulator assemblies are used for controlling the movement of a windowpane, such as a vertically moveable side window of a motor vehicle. Especially in motor vehicle applications, in which the regulator assembly typically is installed in a door cavity below the window opening, the regulator assembly should not interfere with other components, for example, anti-intrusion beams and the like. The cable must be guided along a travel path, preferably being well protected against chaffing and dislocation over extended periods of use in harsh automotive conditions, including temperature and humidity cycles, vibration and perhaps intrusion of foreign objects. Various cable regulator assemblies are known, typically having a drive cable mounted onto one or more cable guides and driven by suitable drive means, for example, a drive drum mounted for reversible rotation by a hand crank, electric motor or the like. The drive cable is attached to one or more driven members, sometimes referred to as gliders, such that the position of the driven member can be controlled by actuating the drive means to controllably drive the cable. Exemplary cable window regulator assemblies for use in motor vehicles are shown in U.S. Pat. No. 4,910,917 to Bauer, entitled Bowden Cable Equipped Window Lift, and in earlier U.S. Pat. No. 4,110,935 to Sessa, entitled Cable-Actuated Car-Side-Window-Lifting Mechanism.

In cable regulator assemblies in which a single glider is used, it generally is rigidly, i.e. fixedly, attached to the windowpane. Nevertheless, single glider designs have been known to provide inadequate stability to the window, allowing it to rock or rotate in its lifting plane as the windowpane is being raised or lowered. It is known that improvement can be obtained by using a pair of gliders attached to the windowpane at spaced locations along its bottom edge. Both the aforesaid Sessa patent and Bauer patent show regulator assemblies employing dual mounting brackets. The advantages of dual guide rails for motor vehicle window regulators are recognized, for example, in commonly owned U.S. Pat. No. 5,398,449 to Kobrehel et al, entitled Window Regulator for a Frameless Door Assembly.

Significant difficulties have been experienced, however, using cable regulator assemblies having such dual mounting brackets or gliders if the brackets are not lifted and lowered along precisely parallel paths. The Bauer patent suggests designs to correct or compensate for misalignment of the guide rails along which the two gliders travel. The two guide rails of Brauer are mounted separately in a vehicle door, and the compounding of manufacturing tolerances and assembly variability leads to lack of adequate parallelism of the two guide rails. Consequently, the Bauer patent suggests that only one glider (referred to as a mounting bracket by Bauer) be rigidly fixed to the windowpane while the other employs a mounting slot or eccentric cam to accommodate such misalignment. This design, however, can lead to reduced windowpane stability.

It is an object of the present invention to provide a cable regulator assembly having improved performance characteristics. It is a further object of the invention to provide a regulator assembly which provides good protection for the regulator cable along its travel path between the laterally spaced guide rails and is compatible with modern automotive design principles. Additional objects and features of the invention will become apparent from the following disclosure taken together with the detailed discussion of certain preferred embodiments.

SUMMARY

In accordance with a first aspect, a cable regulator assembly is provided for controlling the vertical travel of a windowpane in the window opening of a motor vehicle door. Cable regulator assemblies as disclosed here can be used in edge drive regulator designs wherein a vertically moveable windowpane is mounted by two mounting brackets or gliders laterally spaced along its bottom peripheral edge. As used here, the term lateral spacing means spacing in the plane of travel of the windowpane, substantially perpendicular to the direction of travel. In a typical motor vehicle door, employing an edge drive cable regulator assembly in accordance with the principles disclosed here, the gliders are laterally spaced from each other meaning that they are spaced front-to-back of the vehicle, that is, fore-and-aft. The cable regulator assembly includes a cable support structure which is mounted or mountable in a motor vehicle door cavity. The support structure comprises two vertically extending guide rail members, each carrying a corresponding one of the two gliders. Thus, the two guide rail members are laterally spaced and parallel each other. In accordance with a significant feature, the two vertical guide rail members are rigidly interconnected by a lateral bridging member. The lateral bridging member and the two guide rail members cooperatively form an integral, rigid U-shaped structure. Preferably, the U-shaped structure is upwardly open, with the lateral bridging member secured along the bottom structure of the vehicle door. As used here, the bottom structure of the door typically is the lower-most panel or other structure-defining elements of the door together with any associated door componentry mounted in that area. Similarly, the forward or front structure of a door is the generally forward-most vertical panel or like structural elements of the door, together with any associated door componentry mounted in that area, for example, power cables, hinge/lock components, sensors and signal carrying leads, etc. The rear structure of the door is, correspondingly, the generally rearward-most vertical panel or other vertical structural elements of the door, together with any associated components of the door mounted at that area. The rear structure of the door is, of course, spaced rearwardly of the front structure, that is, spaced laterally as that term is explained above. Thus, the front structure and the rear structure together with the bottom structure of a vehicle door define generally a cavity area referred to generally here as the door cavity. It should be understood that reference here to the guide rail members of the cable support structure of the regulator assembly being mounted closely proximate the front structure of the door, as for an edge drive type cable regulator assembly in accordance with the present disclosure, means that the front guide rail member is mounted as closely as practical to the front structure of the door, given the "packaging constraints" imposed by the presence of other door components and structural members, such as anti-intrusion beam attachments, etc., and given the force distribution requirements and like engineering considerations imposed by such factors as the size, orientation and desire to travel path of the windowpane which is controlled by the regulator assembly.

The front guide rail member extends vertically from the lateral bridging member toward a front cable return. Preferably, the cable return is mounted at the upper end of the front guide rail member. Similarly, the second guide rail member extends vertically from its attachment to the lateral bridging member toward a second cable return which, preferably, is mounted at the upper end thereof. Additional cable guide means are mounted to the cable support structure for supporting a regulator cable for driven travel around the front and rear cable returns in a U-shaped travel path along the cable support structure. Front and rear gliders are attached to the regulator cable, as mentioned above, for cable-driven vertical travel along the front and rear guide rail members, respectively. The windowpane which is controlled by the regulator assembly is mounted to the two gliders. In view of the excellent parallelism of the two guide rail members achieved in large measure by the rigid lateral bridging member, the windowpane can be attached rigidly to both of the gliders. This provides excellent operating performance, including windowpane stability with a reduction or even elimination of windowpane jamming and the like in its guide tracks. Most notably, the rigid attachment to both gliders is possible, even with the compounding of dimensional tolerances typical in high volume manufacturing operations such as those of the motor vehicle industry. This is possible due to the achievement of sufficiently precise parallelism between the guide rail members, even over extended periods of use in the harsh automotive environment, due to their rigid attachment of the guide rail members to the rigid bridging member between them. This is especially true in the case of cable regulator assemblies as disclosed here which are preassembled remote from the vehicle door in which they eventually installed. That is, the significant advantage, which those skilled in the area of cable regulator assemblies will recognize as being a significant technology advance, is achieved in large measure by the rigid, integral cable support structure formed by the rigid lateral bridging member acting cooperatively with the vertical guide rail members. Thus, the parallelism of the guide rails maintains the parallelism of the gliders as they travel up and down carrying the windowpane between its opened and closed positions. In accordance with preferred embodiments, therefore, as mentioned above, the gliders can be rigidly mounted to the glass with good three-dimensional positional control and stability. The improved positioning stability, especially in an edge drive arrangement, can in preferred embodiments provide sufficient stability as to permit deletion of certain previously required componentry. For example, in certain preferred embodiments glass run channels may be deleted, providing improved design flexibility. In addition, the felted or flocked bumpers referred to by some in the industry as "boxing gloves" and used to keep a windowpane stable in its vertical movement may also in some cases be deleted. Corresponding advantages are thereby achieved in both componentry cost and assembly cost and complexity reduction.

Additionally, by routing the regulator cable in a corresponding U-shaped travel path along the cable support structure, good protection is provided for the regulator cable along its travel path, especially along that portion of the travel path which extends between the laterally spaced guide rail members. Significant additional advantages which can be achieved in accordance with certain preferred embodiments, include clearing regulator assembly componentry from the center area of the door cavity. Current motor vehicle design principles favor the use of anti-intrusion beams across the center of the vehicle door and/or filling the center of the vehicle door cavity with structural foam or the like for impact energy management. Moreover, by vacating regulator assembly componentry from the center area of the vehicle door cavity, high mass items such as the electric drive motor and the like are less likely to participate in force transfer to a vehicle occupant.

Certain preferred embodiments can provide additional significant advantages with respect to assembly and installation. Specifically, the rigid U-shaped cable support structure enables the cable regulator to be pre-assembled, optionally including even the windowpane premounted to the gliders. Since the regulator assembly is rigid and structurally self-supporting, it is readily adaptable to automatic, e.g., robotic, transfer and installation. Pre-assembly and automatic installation in accordance with such preferred embodiments are especially applicable to so-called "outside load" type motor vehicle doors, wherein door components are installed into the door cavity from the outside and the outer panel of the door is thereafter attached. Additional features and advantages of the cable regulator assembly disclosed here will be apparent from the following detailed discussion of certain preferred embodiments.

BRIEF DESCRIPTION OF THE DRAWINGS

Certain preferred embodiments are discussed below with reference to the appended drawings wherein.

Figure 1:
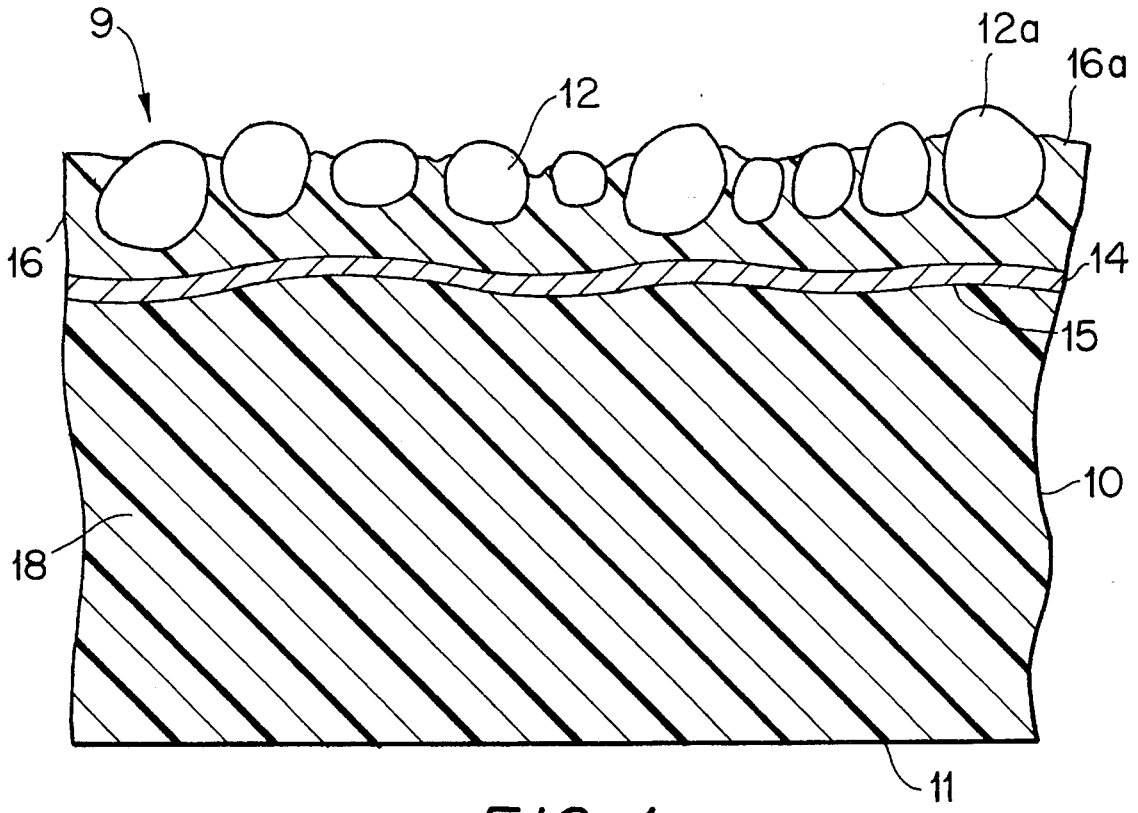
FIG. 1 is a schematic elevation view of a cable regulator assembly in accordance with a preferred embodiment.
Figure 3:
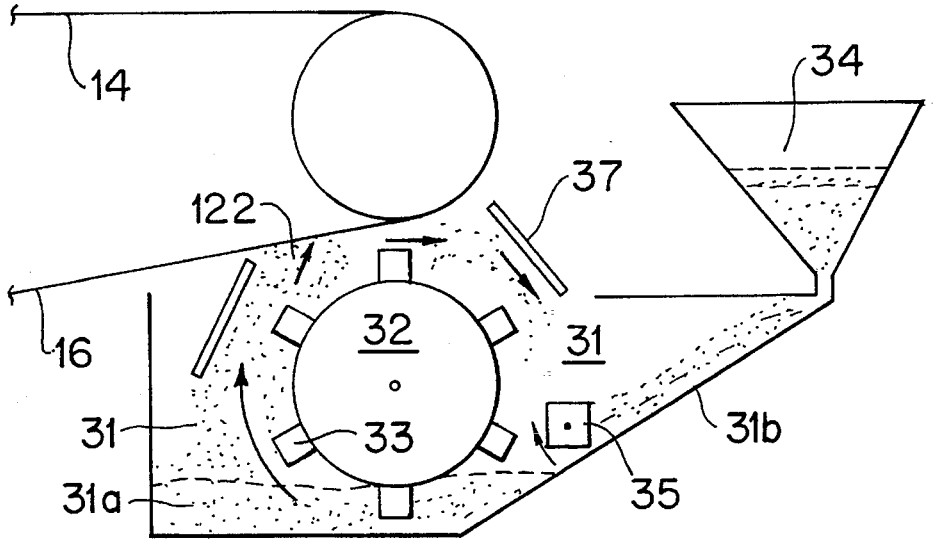
FIG. 3 is a section view taken through line 3—3 of FIG. 1.
Figure 2:
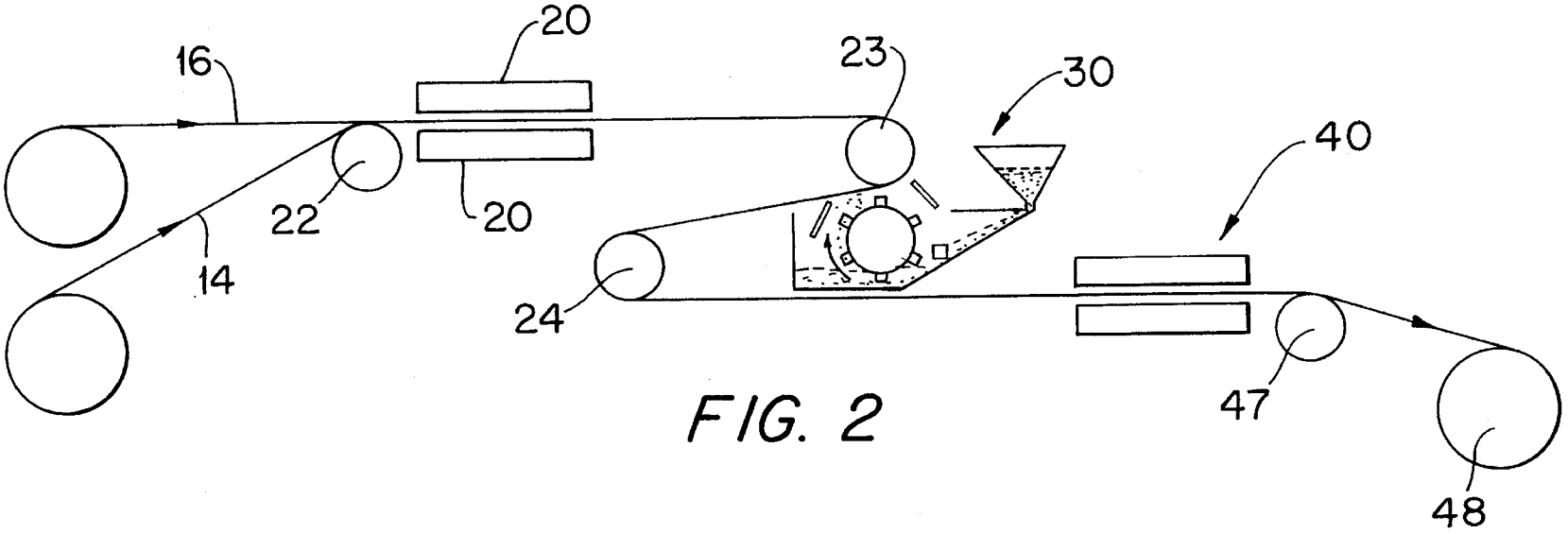
FIG. 2 is a side elevation view of the cable regulator assembly of FIG. 1, partially in section, taken through line 2—2 of FIG. 1.

It should be understood that the appended drawings are not necessarily to scale, presenting a somewhat simplified representation of certain preferred embodiments illustrative of the basic principles of the invention. The specific design of cable regulator assemblies in accordance with the invention, including, for example, the specific configuration and dimensions of various components, will be determined in part by the intended application and use environment of the regulator assembly. Certain features of the regulator assembly depicted in the appended drawings have been enlarged or distorted relative to others to facilitate visualization and clear understanding. In particular, thin features may be thickened, for example, for clarity of illustration. All references to direction and position, unless otherwise indicated, refer to the orientation of the regulator assemblies illustrated in the drawings. It should be understood, however, that cable regulator assemblies in accordance with the invention can be used in diverse applications.

DETAILED DESCRIPTION OF CERTAIN PREFERRED EMBODIMENTS

The cable regulator assembly illustrated in FIGS. 1–5 is suitable for use in controlling a moveable windowpane to open and close a window opening in a motor vehicle door. The regulator assembly is seen to have a U-shaped support structure which includes an elongate lateral member 10 which, typically, would approximately span the lateral (that is, fore-and-aft) dimension of the door cavity. Front vertical guide member 12 extends in a generally vertical direction upwardly from attachment to lateral member to the front end 14 of lateral member 10. Similarly, rear guide rail 16 extends upwardly from attachment to the rearward end 18 of lateral member 10. Since the cable regular assembly illustrated in FIGS. 1–5 is adapted for a preferred edge drive application, the guide rails are widely laterally spaced on lateral member 10. Nevertheless, lateral member 10 may extend at one or both ends beyond the guide rails, as in the illustrated embodiment, to facilitate mounting of the regulator assembly inside the door cavity. The vertical guide rail members 12, 16 are rigidly attached to lateral member 10. Lateral member 10 is itself substantially rigid, with stable longitudinal dimension, so as to best maintain the precise parallelism of the two guide rails. Most preferably lateral member 10 is formed of stamped steel or other rigid material suitable for a motor vehicle application. It will be apparent to those skilled in the art in view of the present disclosure that the U-shaped cable support structure formed by the lateral member and two guide rails can also be employed in a downwardly open orientation. That is, lateral member 10 can bridge between the upper ends of the guide rails. In such embodiments the lateral member preferably is positioned at approximately at the so-called belt line of the door immediately below the window opening. More generally, since the U-shaped cable support structure formed by the lateral member and vertical guide rails is substantially rigid, it can be mounted within the door cavity utilizing any set of convenient mounting points. The guide rail members typically will form an angle of 80° to 100° with the lateral bridging member 10. The exact angle will depend in large part on the configuration of the vehicle door and the intended direction of window travel relative the lateral bridging member.

A front cable return 20 is mounted at the upper end 22 of guide rail member 12. A rear cable return 24 is mounted at the upper end 26 of the rear guide rail member 16. The two guide rail members can be configured in accordance with known design principles for cable regulator assemblies, modified as needed for rigid attachment to lateral member 10 in accordance with the principles disclosed here. The guide rail members can be formed of stamped sheet steel or other sufficiently rigid and durable material suitable for motor vehicle applications.

A pair of cable guides 28, 29 are mounted near the lower end 30 of front guide rail member 12. Similarly, a pair of cable guides 31, 32 are mounted toward the lower end 34 of rear guide rail member 16. The cable guides 28, 29 and 31, 32 thus establish turning points for the side-by-side lengths of regulator cable 35 at the front elbow and rear elbow, respectively, formed by the guide rail members and the lateral bridging member. Preferably the two cable returns 20, 24 and the aforesaid cable guides 28, 29, 31 and 32 are all free-wheeling pulleys to provide good regulator cable travel performance characteristics. In accordance with a particularly preferred embodiment, the front cable return is a free-wheeling pulley mounted for rotation in a plane substantially perpendicular to the plane of the U-shaped cable support structure and the front cable guides 28, 29 are free-wheeling pulleys in approximate vertical alignment with the front cable return and have a common axis of rotation which is substantially normal to the plane of the U-shaped support structure. Similarly, in this preferred embodiment, the rear cable return is a free-wheeling pulley mounted for rotation in a plane substantially perpendicular to the U-shaped cable support structure and the rear cable guides are free-wheeling pulleys in approximate vertical alignment with the rear cable return, having a common axis of rotation substantially normal to the plane of the U-shaped cable support structure. In this preferred embodiment the front guide rail member 12 acts essentially as a mounting bracket for the front cable return 20 and for the front cable guides 28, 29. Likewise, rear guide rail member 16 provides mounting for the rear cable return 24 and the rear cable guides 31, 32. Excellent reduction in componentry can be achieved in this manner, along with simplification of assembly. This is particularly advantageous where the cable regulator assembly is to be produced as an integrated preassembly prior to installation in a door cavity, allowing the regulator cable to be pre-mounted onto the cable support structure.

It will be apparent to those skilled in the an in view of the present disclosure that various alternative and/or additional cable guides can be employed in the cable regulator assembly disclosed here. Thus, for example, the regulator cable 35 may be sheathed along some or all of its travel path, with such sheathing fixed at one or more locations to the support structure. In lieu of free-wheeling pulleys, a radiused turning surface such as an upstanding curved flange may be used. It will be understood in view of this disclosure that the selection of suitable cable guides and their placement on the support structure depend in large measure on the particular application for which the regulator assembly is intended. In general, however, significant advantage is achieved by the U-shaped travel path of the regulator cable 35 along the correspondingly U-shaped rigid cable support structure, as discussed above.

Front and rear gliders are mounted to the front and rear guide rail members, respectively. The gliders and guide rail members have cooperating configurations. That is, the guide rail members act as a guide rail in accordance with known design principles to engage the gliders and permit them only sliding vertical travel along the guide rail. Specifically, in the embodiment illustrated in FIGS. 1–5, front glider 36 is captured for sliding vertical travel along front guide rail member 12. Similarly, rear glider 38 is captured for vertical sliding travel along rear guide rail member 16. The gliders also are fixedly attached to one or another of the two lengths of regulator cable extending vertically along the front and rear guide rail members, respectively. Windowpane 40 is rigidly mounted to both front glider 36 and rear glider 38 in accordance with the principles discussed above. It may be attached either after the cable regulator assembly is mounted in a door cavity or prior to installation as part of an integrated preassembly.

Figure 4:
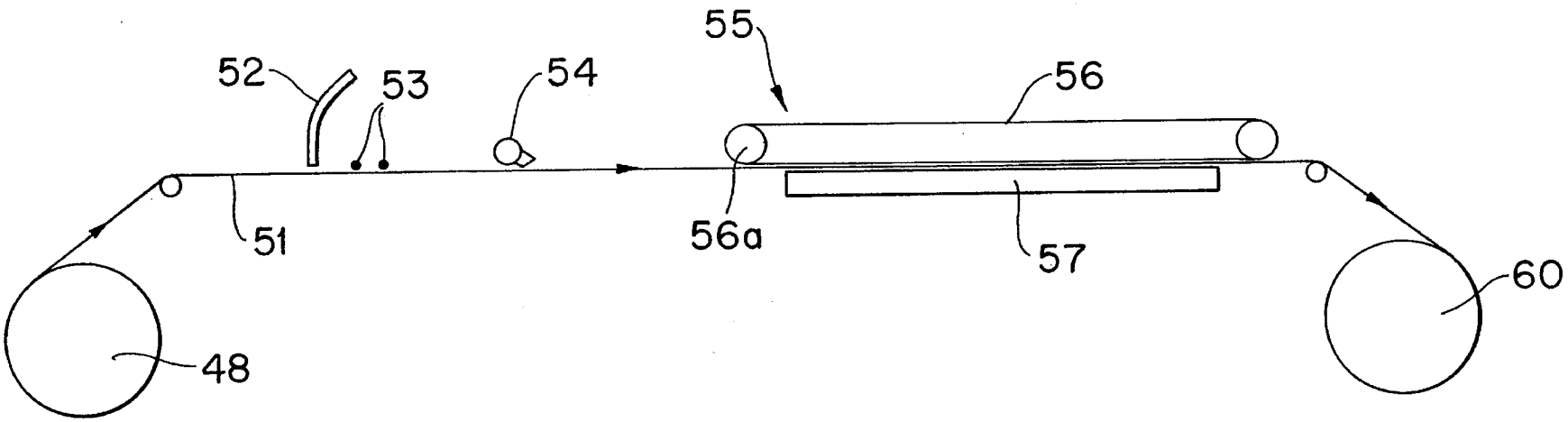
FIG. 4 is an enlarged, exploded perspective view of area 4 of the cable regulator assembly of FIG. 1.

The cable regulator assembly of FIGS. 1–5 further includes an electric motor 42 which is operatively connected to a cable drive drum 44. Regulator cable 35 is wrapped about the outer surface of drive drum 44, such that actuation of electric motor 42 drives the regulator cable along its travel path, thereby raising or lowering the windowpane. Especially in those preferred embodiments wherein the lateral bridging member is mounted proximate the bottom of the door cavity, that is, along the bottom structure of the door, electric motor 42 preferably is mounted close to the lateral member and, optionally, and, most preferably, directly to the lateral member. This is especially advantageous in those embodiments of the cable regulator assembly which are produced as a preassembly prior to installation in the vehicle door. By positioning the electric motor low in the door cavity, it furthers the advantages discussed above of leaving the center area of the door cavity free of regulator assembly components. Suitable alternative means for driving the cable will be apparent to those skilled in the art in view of the present disclosure. A hand crank may be used, for example, in accordance with design principles whose application to the present invention will be apparent in view of this disclosure. The hand crank may be operatively interconnected to the regulator cable by a drive drum or other suitable means in accordance with design techniques which are well-known to those skilled in the art. In accordance with certain preferred embodiments, the drive drum 44 may have a variable drum diameter as disclosed in presently pending, commonly owned U.S. patent application Ser. No. 08/369,718, the disclosure of which is incorporated herein by reference. In such embodiments, the operating surface of the drive drum about which regulator cable 35 is wrapped one or more times has a diameter which varies either continuously or in a stepwise fashion. Cable tensioning means are used, preferably, in cable regulator assemblies having such variable diameter drive drum. Cable tensioning means can be provided in the embodiment illustrated in FIG. 1–5 as shown in FIG. 4. A mounting plate 46 is vertically slidable at the upper end 22 of front guide rail 12. Specifically, as best seen in FIG. 4, front cable return 20 comprises a pulley 48 mounted for free-wheeling rotation on plate 46 by means of pin 50. Slots 52 and 54 in plate 46 receive upstanding tabs 56 and 58 of bracket 59 on guide rail member 12. Slots 52 and 54 are sufficiently long to permit plate 46 a range of vertical travel on guide rail member 12. Coil spring 60 is fit with compression between upstanding tab 62 of guide rail member 12 and tab 64 of mounting plate 46. More specifically, tab 64 and tongue 68 of tab 62 fit into opposite ends of coil spring 60 such that it is captured between them. Thus, mounting plate 46 is biased upwardly by spring 60 so as to take slack, if any, out of regulator cable 35. A similar mounting plate arrangement can be used for the rear cable return to provide additional tensioning capability. Suitable additional or alternative tensioning means will be apparent to those skilled in the art in view of the present disclosure.

Figure 5:
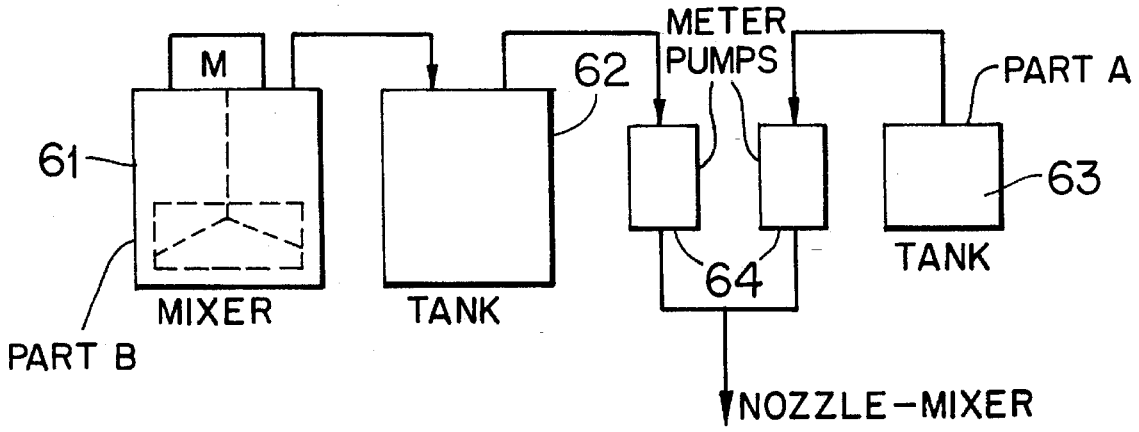
FIG. 5 is a schematic elevation view of the cable regulator of FIGS. 1–4 being installed in a door cavity of a motor vehicle to provide an edge drive arrangement for the door window.
Figure 6:
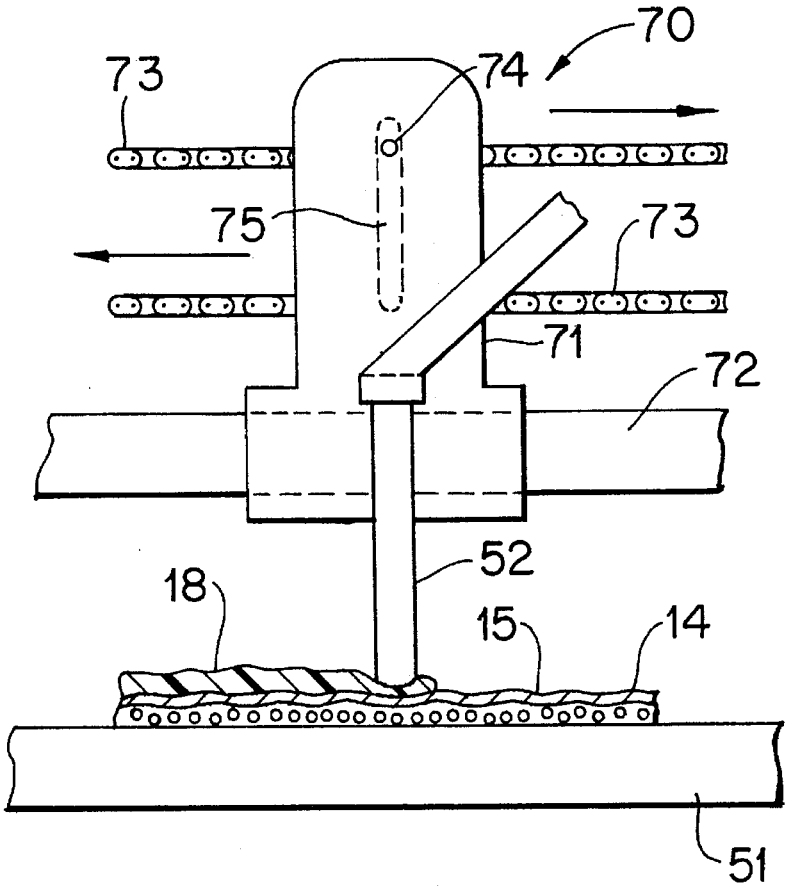
Figure 7:
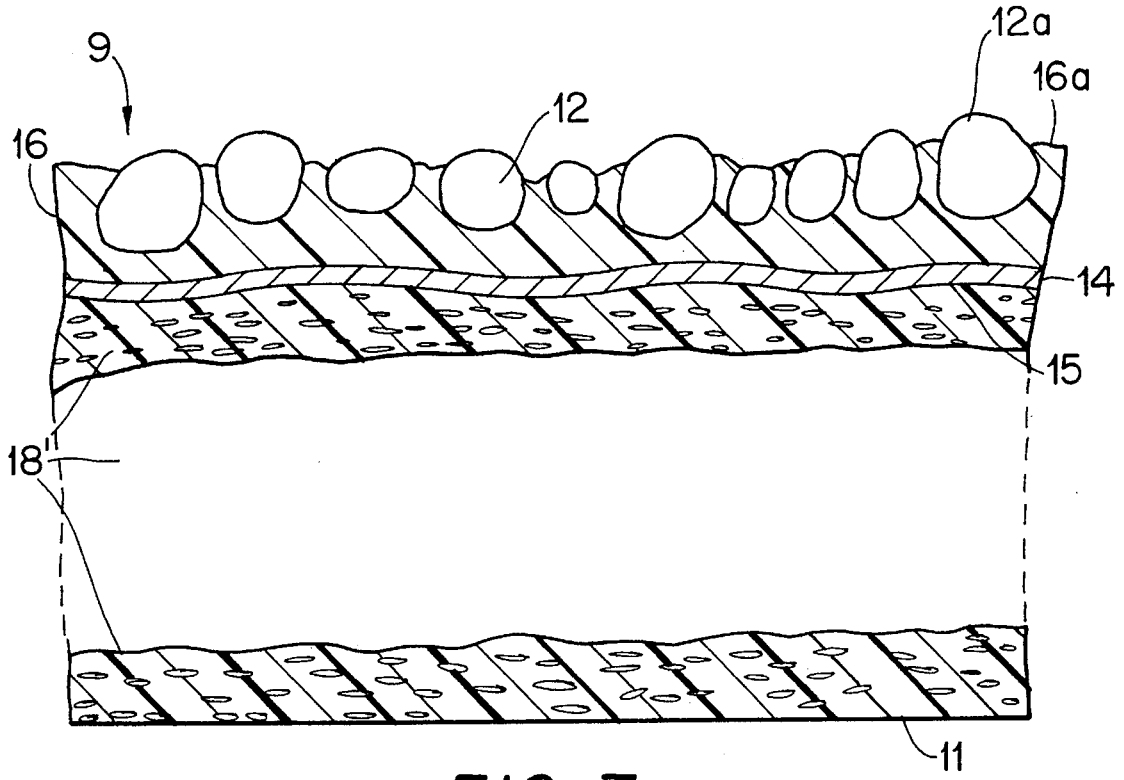
Figure 8:
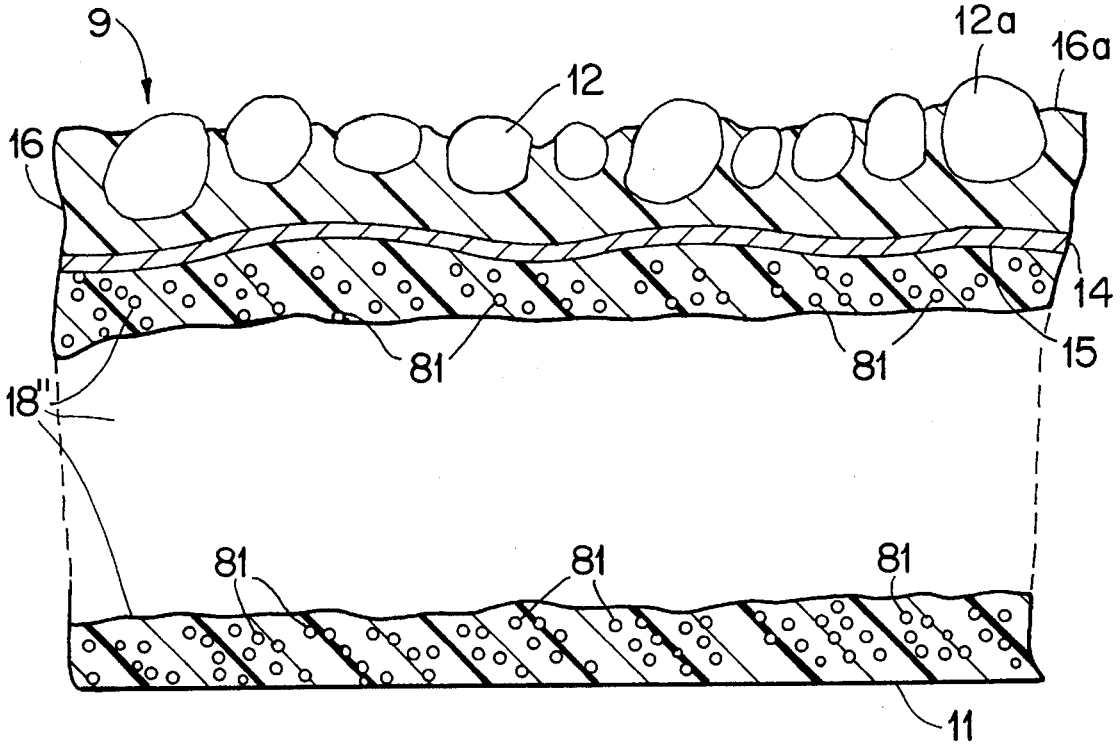
Figure 1:
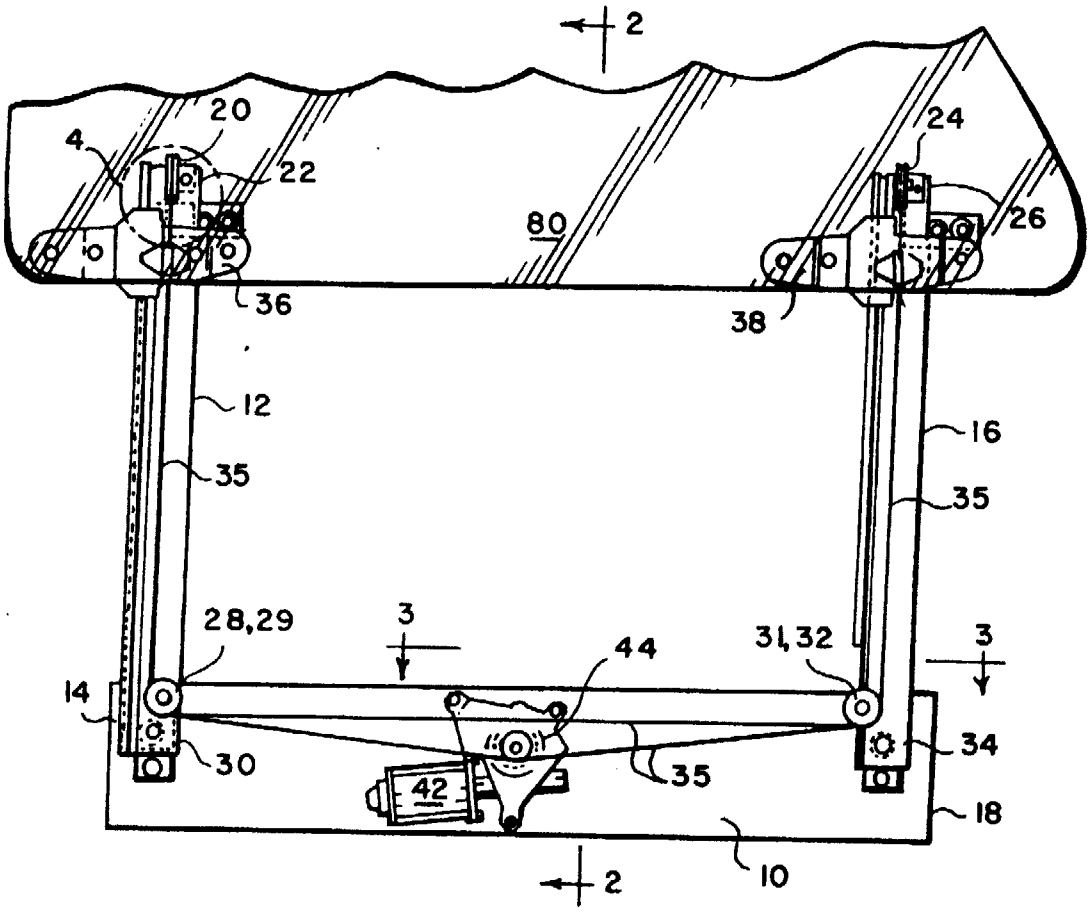
Figure 2:
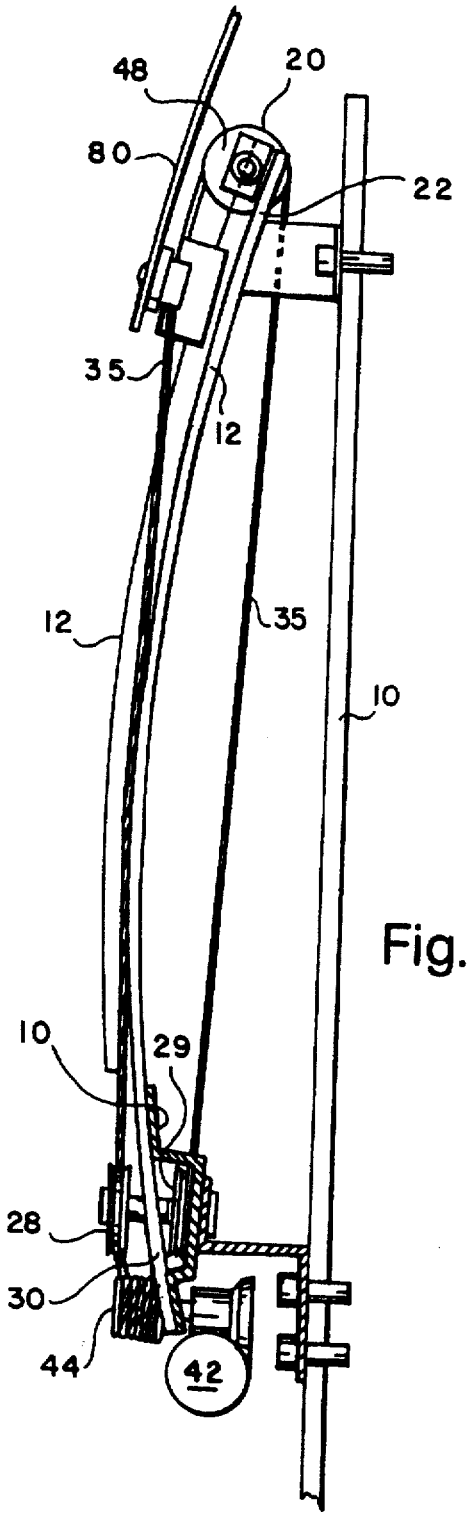
Figure 3:
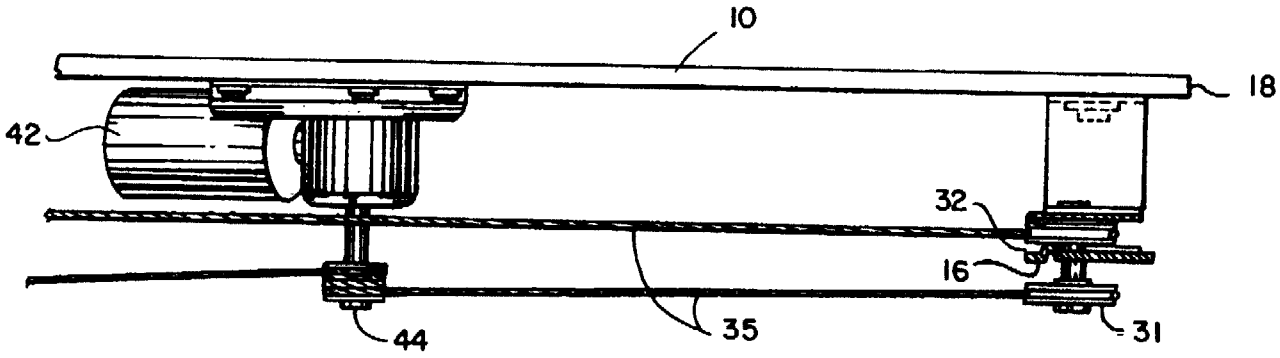
Figure 4:
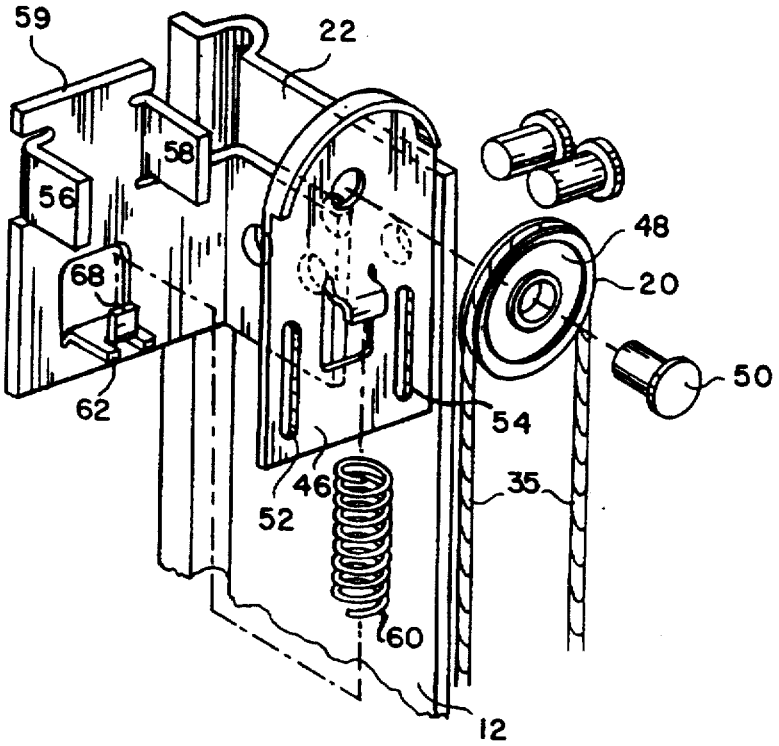
Figure 5:
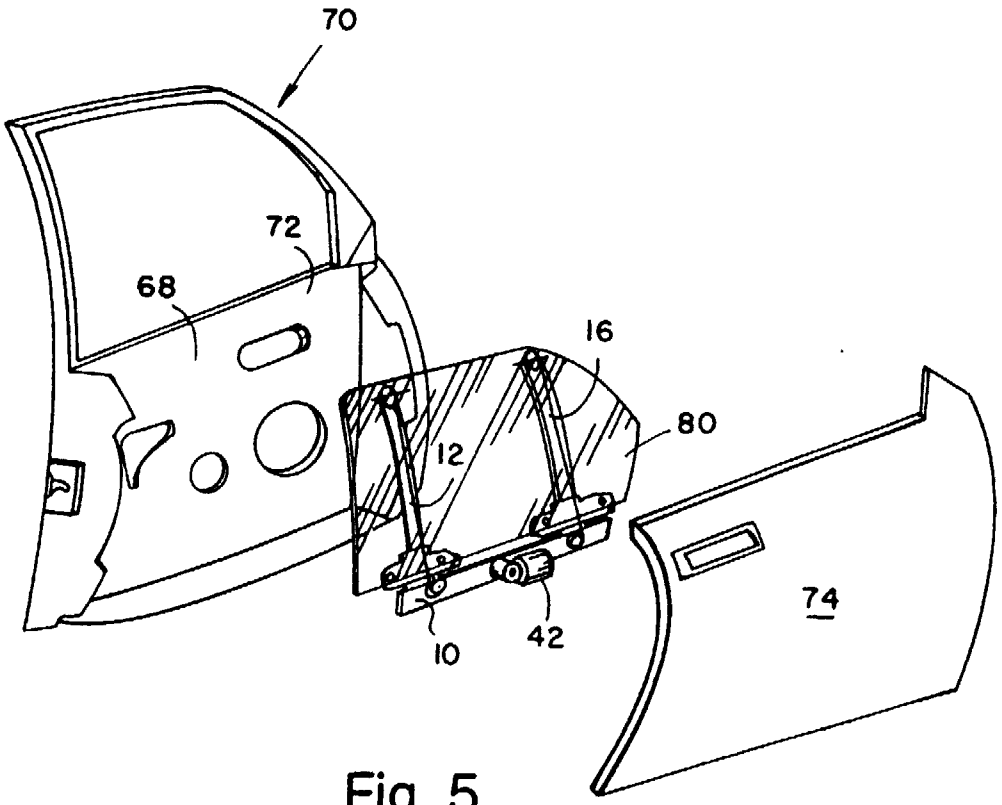

The cable regulator assembly of FIG. 1, as an integrated unit incorporating a windowpane 80 can be installed as a unit into the cavity of a motor vehicle door. More specifically, as seen in FIG. 5 door cavity 68 of motor vehicle door 70 is substantially open for installation of the cable regulator assembly, since door 70 is of the outside load type. Once installed into the door cavity 68, the regulator assembly is fixed in position by suitable mounting means, such as by bolting the regulator assembly to structural inner door panel 72. Thereafter, exterior door panel 74 can be mounted onto the vehicle door 70 in accordance with known assembly techniques. A structural anti-intrusion beam can be installed either separately or as part of exterior panel 74, and would be positioned outboard of the regulator assembly and windowpane 80.

It will be apparent from the foregoing discussion that numerous alternative embodiments exist within the true scope and spirit of the present invention. The following claims are intended to cover such alternative embodiments.

I claim:

1. A cable regulator assembly for controlling the vertical travel of a windowpane in a window opening of a motor vehicle door, comprising, in combination:

a cable support structure mountable in a door cavity of a motor vehicle, comprising a lateral bridging member, a first guide rail member extending vertically from the bridging member toward a first cable return, and a second guide rail member laterally spaced from the first guide rail member and extending vertically from the bridging member toward a second cable return, the lateral bridging member, first guide rail member and second guide rail member cooperatively forming an integral, rigid U-shape;

a regulator cable;

cable guide means mounted to the cable support structure for supporting the regulator cable for driven travel around the first and second cable returns in a U-shaped travel path along the cable support structure; and first and second gliders attached to the regulator cable for cable-driven vertical travel along the first and second guide rails, respectively, each having mounting means for attachment to a windowpane.

2. A cable regulator assembly, for controlling the vertical travel of a windowpane in a windowpane in a window opening of a motor vehicle door comprising, in combination:

a rigid, integral, U-shaped cable support structure mountable in a motor vehicle door cavity defined generally by bottom structure of the door below the cavity, front structure of the door laterally forward of the cavity and rear structure of the door laterally rearward of the cavity, comprising a laterally extending, elongate lower bridging member having means for rigid attachment to the motor vehicle door proximate the bottom structure of the door, a front guide rail member extending upward from rigid attachment to the lower bridging member at a forward location, and a rear guide rail member parallel the front guide rail member and spaced laterally rearward thereof, extending upward from rigid attachment to the lower bridging member at a rearward location;

a front cable return mounted to the front guide rail member and a rear cable return mounted to the rear guide rail member;

cable guides mounted to the cable support structure, including at least a pair of front cable guides proximate the forward mounting location and a pair of rear cable guides proximate the rearward mounting location;

a regulator cable mounted on the front and rear cable returns and cable guides for driven travel in a U-shaped travel path along the cable support structure:

front and rear gliders attached to the regulator cable for cable-driven vertical travel along the front and rear guide rail members, respectively; and a windowpane attached to the front and rear gliders for vertical travel.

3. The cable regulator assembly of claim 2 wherein the front and rear guide rail members each forms an angle of 80° to 100° with the lower bridging member.

4. The cable regulator assembly of claim 2 wherein:

a) the front cable return is a free-wheeling pulley mounted for rotation in a plane substantially perpendicular to the plane of the U-shaped cable support structure, b) the front cable guides are free-wheeling pulleys in approximate vertical alignment with the front cable return and have a common axis of rotation which is substantially normal to the plane of the U-shaped cable support structure, c) the rear cable return is a free-wheeling pulley mounted for rotation in a plane substantially perpendicular to the plane of the U-shaped cable support structure, and d) the rear cable guides are free-wheeling pulleys in approximate vertical alignment with the rear cable return and have a common axis of rotation which is substantially normal to the plane of the U-shaped cable support structure.

5. The cable regulator assembly of claim 2 further comprising drive means for reversibly driving the regulator cable along the U-shaped travel path.

6. The cable regulator assembly of claim 5 wherein the drive means comprises a drive drum about which the regulator cable is wrapped, and an electric motor mounted at the lower bridging member and having an output member operatively connected to the drive drum.

7. The cable regulator assembly of claim 2 further comprising tensioning means operatively engaging the regulator cable for taking up slack in the regulator cable.

8. The cable regulator assembly of claim 2 wherein the windowpane is fixedly attached to both the front and rear gliders.

9. A preassembled cable regulator assembly suitable to be mounted as a unit into a motor vehicle door cavity, for controlling a moveable windowpane to open and close a window opening of the motor vehicle door, comprising, in combination:

a lateral bridging member;

an elongate front guide rail member having a lower end attached to the lateral bridging member at a front attachment location, and having a free end supporting a front cable return;

an elongate rear guide rail member having a lower end attached to the lateral bridging member at a rear attachment location, and having a free end supporting a rear cable return, the lateral bridging member, front guide rail member and rear guide rail member cooperatively forming a U-shaped cable support structure in which the front guide rail member is rigidly parallel the rear guide rail member;

an electric motor mounted to the lateral bridging member and carrying a cable drive drum;

a regulator cable mounted to the cable support structure in a U-shaped travel path, extending from engagement with the cable drive drum around the front and rear cable returns guided by front and rear cable guides proximate the front and rear attachment locations, respectively; and front and rear gliders attached to the regulator cable for driven travel along the front and rear guide rails, respectively, each of the gliders having mounting means for attachment to a windowpane.

10. The cable regulator assembly of claim 9 further comprising a windowpane fixedly attached to both of the gliders.

11. A cable regulator assembly mounted in a motor vehicle door cavity defined in part by front structure, bottom structure and rear structure of the door, for controlling a moveable windowpane to open and close a window opening of the motor vehicle door, comprising, in combination:

an elongate, substantially horizontal lateral beam secured in position proximate the bottom structure of the motor vehicle door;

an elongate front glider beam rigidly secured at a forward attachment to the lateral beam, forming therewith a front elbow, and extending vertically upward proximate the front structure of the vehicle door, defining a front glider guide channel extending upward toward a front cable return;

an elongate rear glider guide beam rigidly secured at a rearward attachment to the lateral beam, forming therewith a back elbow, and extending vertically upward proximate the rear structure of the vehicle door, defining a rear glider guide channel extending upward toward a rear cable return, the lateral beam, front glider beam and rear glider beam cooperatively forming an upwardly open U-shaped cable support structure in which the front glider guide channel is rigidly parallel the rear glider guide channel;

a cable drive drum mounted at the lateral beam for driven rotation;

a regulator cable mounted to the cable support structure in an upwardly open U-shaped travel path, extending from driven engagement with the cable drive drum around the front cable return, with cable turning points at a pair of front cable guides at the front elbow, and around the rear cable return, with cable turning points at a pair of rear cable guides at the rear elbow;

a front glider rigidly attached to the windowpane and attached to the regulator cable for driven travel engaged with the front glider guide channel; and a rear glider rigidly attached to the windowpane and attached to the regulator cable for driven travel engaged with the rear glider guide channel in tandem with the front glider.

12. The cable regulator assembly of claim 11 further comprising an electric motor mounted to the lateral beam and being operatively interconnected with the cable drive drum.

* * * * *

UNITED STATES PATENT AND TRADEMARK OFFICE

CERTIFICATE OF CORRECTION

PATENT NO. : 5,613,322
DATED : Mar. 25, 1997
INVENTOR(S) : Michael D. Kobrehel

It is certified that error appears in the above-identified patent and that said Letters Patent is hereby corrected as shown below:

The title page showing the illustrative figure should be deleted and substituted with the attached title page.

The drawing sheets consisting of figs. 1-8 should be deleted and substituted with the attached drawing sheets consisting of figs. 1-5.

Signed and Sealed this

Seventeenth Day of June, 1997

*Attest:*

*Attesting Officer*

BRUCE LEHMAN

*Commissioner of Patents and Trademarks*

United States Patent [19]

Kobrehel

[11] Patent Number: 5,613,322

[45] Date of Patent: Mar. 25, 1997

[54] EDGE DRIVE CABLE WINDOW REGULATOR ASSEMBLY

[75] Inventor: Michael D. Kobrehel, Elkhart, Ind.

[73] Assignee: Excel Industries, Inc., Elkhart, Ind.

[21] Appl. No.: 550,657

[22] Filed: Oct. 31, 1995

[51] Int. Cl.[6] ..... E05F 11/48

[52] U.S. Cl. ..... 49/352; 49/349

[58] Field of Search ..... 49/349, 352, 360, 49/380

[56] References Cited

U.S. PATENT DOCUMENTS

| | | | |
|---|---|---|---|
| 2,501,092 | 3/1950 | Rappl | 49/352 X |
| 4,110,935 | 9/1978 | Sessa . | |
| 4,910,917 | 3/1990 | Brauer . | |
| 4,934,099 | 6/1990 | Maekawa et al. | 49/352 |
| 5,035,083 | 7/1991 | Kruzich | 49/352 |
| 5,074,077 | 12/1991 | Toyoshima et al. | 49/352 |
| 5,120,151 | 6/1992 | Farris et al. . | |
| 5,195,211 | 3/1993 | Krajenke . | |
| 5,226,259 | 7/1993 | Yamagata et al. | 49/352 X |
| 5,263,282 | 11/1993 | Cooper et al. . | |

*Primary Examiner*—Philip C. Kannan

*Attorney, Agent, or Firm*—Banner & Witcoff, Ltd.

[57] ABSTRACT

A cable regulator assembly for controlling the vertical travel of a windowpane in the window opening of a motor vehicle has a cable support structure comprising first and second guide rail members extending vertically from laterally-spaced attachment to a lateral bridging member. The lateral bridging member, first guide rail member and second guide rail member cooperatively form an integral, rigid U-shaped structure. A regulator cable is mounted by suitable cable guide means for driven travel in a U-shaped travel path along the cable support structure. First and second gliders are attached to the regulator cable for cable-driven vertical travel along guide rails formed by the guide rail members. The gliders provide mounting means for attachment to the windowpane. The U-shaped cable support structure and corresponding U-shaped travel path of the regulator cable leave the center area of a door cavity advantageously clear of regulator assembly components. In addition, the rigid, integrated cable support structure provides excellent parallelism between the guide rails for improved regulator assembly performance characteristics, and optional rigid attachment of the windowpane to both gliders. The regulator cable is advantageously protected by the rigid lateral member bridging between the two guide rails.

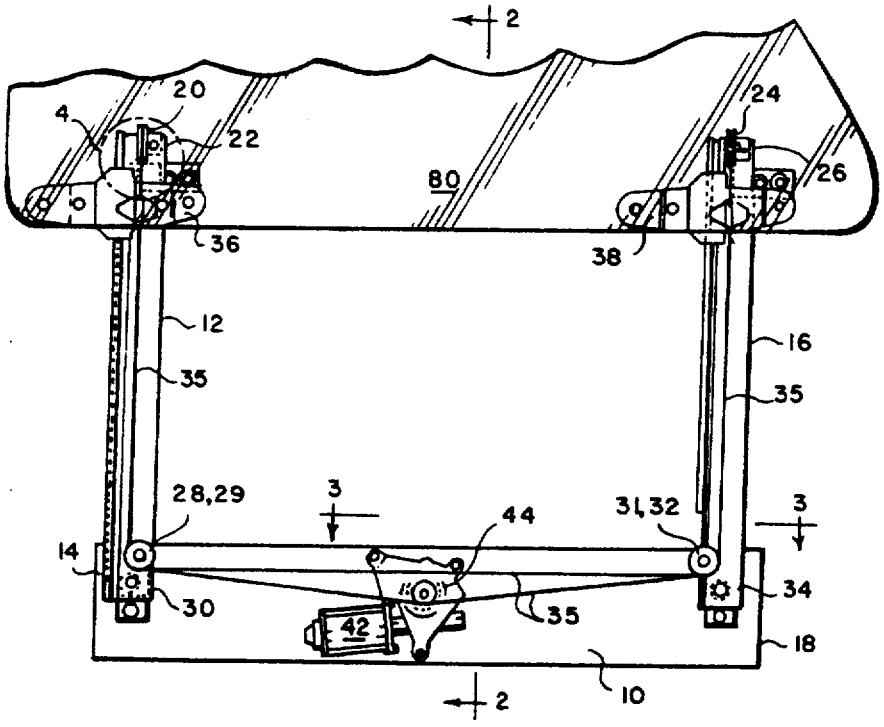

12 Claims, 5 Drawing Sheets